United States Patent [19]

Thoma et al.

[11] 4,382,553

[45] May 10, 1983

[54] FUEL INJECTION NOZZLE FOR AN AIR-COMPRESSING INTERNAL COMBUSTION ENGINE

[75] Inventors: Frank Thoma, Stuttgart; Kurt Obländer, Kernen i. R., both of Fed. Rep. of Germany

[73] Assignee: Daimler-Benz Aktiengesellschaft, Stuttgart, Fed. Rep. of Germany

[21] Appl. No.: 242,613

[22] Filed: Mar. 11, 1981

[30] Foreign Application Priority Data

Mar. 11, 1980 [DE] Fed. Rep. of Germany ..... 3009219

[51] Int. Cl.[3] ..... F02M 61/20

[52] U.S. Cl. ..... 239/533.9

[58] Field of Search ..... 239/533.3–533.13, 239/453

[56] References Cited

U.S. PATENT DOCUMENTS 3,542,293 11/1970 Bishop et al. ..... 239;/533.12 X 4,153,205 5/1979 Parrish ..... 239/533.9

*Primary Examiner*—John J. Love

*Assistant Examiner*—Gene A. Church

*Attorney, Agent, or Firm*—Craig & Burns

[57] ABSTRACT

A fuel injection nozzle for air-compressing internal combustion engines, especially a throttle-pin nozzle wherein a nozzle needle, urged against a conical valve seat by a compressing spring, is lifted with respect to the compression spring by a feed pressure in the fuel. A device is provided for rotating the nozzle needle about its longitudinal axis. The device for effecting rotation is arranged between the nozzle needle and a spring disk and is fashioned in such a way and controlled by a stroke motion of the nozzle needle in such a manner that the nozzle needle, during each closing stroke, is further rotated stepwise in one direction by a specific peripheral angle.

7 Claims, 2 Drawing Figures

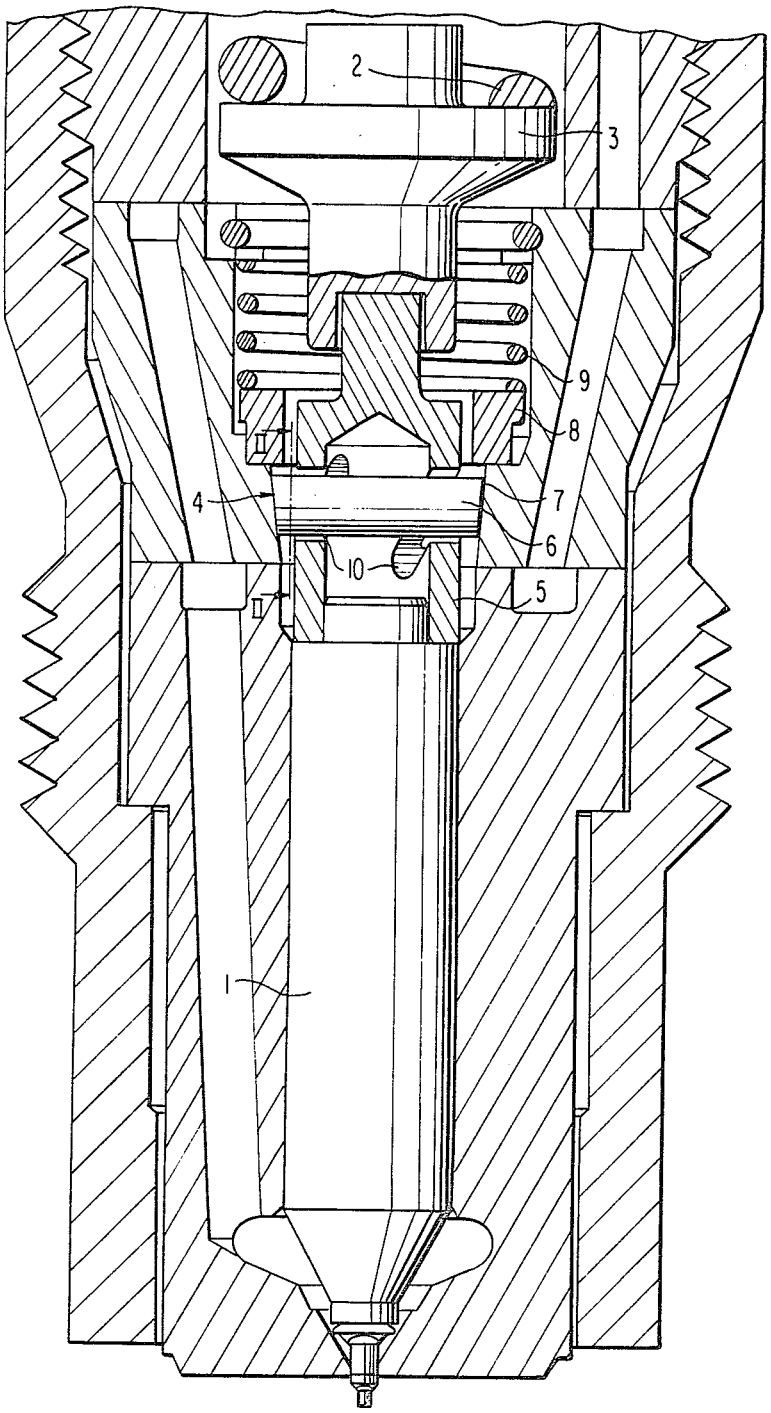
FIG. 1
FIG. 2
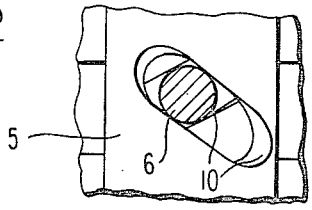

FUEL INJECTION NOZZLE FOR AN AIR-COMPRESSING INTERNAL COMBUSTION ENGINE

The present invention relates to a nozzle and, more particularly, to a fuel injection nozzle for air-compressing internal combustion engines, with the nozzle being constructed of a throttle-pin nozzle wherein a nozzle needle, urged against a conical valve seat by a compression spring, is lifted against the bias of the compression spring by a fuel feed pressure, and wherein a device is provided for rotating the nozzle needle about a longitudinal axis thereof.

In Auslegeschrift No. 1,252,968, a fuel injection nozzle is proposed wherein a rotation of the nozzle needle is effected in dependence upon a load by a coupling of an adjusting lever with the throttle linkage of the internal combustion engine or by means of a temperature sensor in order to vary the injection direction of the injection nozzle so as to enable the conducting of differing combustion processes. The rotation of the nozzle needle in this proposed construction is possible only within a certain peripheral or circumferential angle.

With injection nozzles having a cylindrical projection which enters into a nozzle bore on a combustion chamber end of the nozzle needle, that is, a so-called throttle-pin nozzle, in a first phase of lifting of the nozzle needle, fuel is injected through a narrow angular gap between the throttle pin and the nozzle bore so as to achieve a control of the injection characteristics. Generally, the width of the angular gap ranges between from 10–20$\mu$.

During an operation of an internal combustion engine, carbon deposits are formed on inner surfaces of the angular gap resulting in a narrowing of a width of the gap as well as greatly altering the size and shape of the cross-section of the gap.

With an increased operating time of the internal combustion engine, the size of the cross-section of the gap between the throttle pin and nozzle bore is generally reduced and, after a certain operating time period, the individual injection nozzles of the internal combustion engine may become entirely clogged due to coking or the like. As can readily be appreciated, if a complete clogging by coking occurs, the desired control function of the throttle pin of the fuel injection nozzle is completely lost thereby adversely effecting the operation of the engine resulting in the generation of combustion noise.

Moreover, a dimensional alteration of the angular gap between the throttle pin and nozzle bore due to the naturally irregular surface as well as due to the occasional and localized crumbling of coke deposits has a disadvantageous effect not only on the configuration of the injected spray of fuel and on the atomization but also, consequently, on the combustion process.

The aim underlying the present invention essentially resides in providing a fuel injection nozzle for an air-compressing internal combustion engine which includes a nozzle needle which continuously rotates in a stepwise fashion during operation so as to substantially increase the life span or lifetime of the injection nozzle.

By virtue of the utilization of a rotary motion of a nozzle needle in accordance with the present invention, it is ensured that, in spite of the presence of a layer of coke, a uniform residual angular gap remains between the projection at the nozzle needle and the nozzle bore.

In accordance with advantageous features of the present invention, a means is provided for rotating the nozzle needle with the means being arranged between the nozzle needle and a spring disk. The rotating means is constructed and controlled in such a manner by the stroke motions of the nozzle needle that the nozzle needle, during each closing stroke, is further rotated in a stepwise manner in one direction by a certain peripheral or circumferential angle.

By virtue of the stepwise progressive rotation of the nozzle needle about its longitudinal axis, the meshing parts of the coke deposit on the projection of the nozzle needle and of the coke deposit on an outer surface of the nozzle bore are broken away. Moreover, the coke layer on the nozzle bore and layer on the projection of the nozzle needle are abraded off against each other during rotation of the nozzle needle since, due to manufacturing tolerances, the projection at the nozzle needle lies, in most cases, somewhat eccentrically with respect to the nozzle bore.

In accordance with the present invention, the means for effecting rotation of the nozzle needle may include a sleeve seated on the nozzle needle and rotatably supported on the spring disk, with the sleeve being provided with guide surfaces which are mutually opposed to each other and extend in respectively oppositely running helical paths, with a pivot pin inserted in the guiding surfaces, which pivot pin projects on both sides from the sleeve and rests with its end on the clamping cone in a closed position of the nozzle needle.

Advantageously, a stop ring may be provided above the pivot pin, with the ends of the pivot pin projecting from the sleeve abutting against the stop ring after a predetermined opening stroke of the nozzle needle.

In accordance with further features of the present invention, the stop ring may be arranged so as to be displaceable against a compression spring in order to compensate for manufacturing tolerances.

Accordingly, it is an object of the present invention to provide a fuel injection nozzle for an air-compressing internal combustion engine which avoids, by simple means, shortcomings and disadvantages encountered in the prior art.

Another object of the present invention resides in providing a fuel injection nozzle for air-compressing internal combustion engines which significantly increases the lifetime of the fuel injection nozzle.

Yet another object of the present invention resides in providing a fuel injection nozzle for air-compressing internal combustion engines which prevents a clogging of the fuel injection nozzle through coke deposit.

A still further object of the present invention resides in providing a fuel injection nozzle for air-compressing internal combustion engines which ensures the existence of a uniform angular gap between a nozzle needle and nozzle bore of the fuel injection nozzle.

A still further object of the present invention resides in providing a fuel injection nozzle for air-compressing internal combustion engines which is simple in construction and therefore relatively inexpensive to manufacture.

Another object of the present invention resides in providing a fuel injection nozzle for air-compressing internal combustion engines which functions reliably under all operating conditions.

These and other objects, features, and advantages of the present invention will become more apparent from the following description when taken in connection with the accompanying drawings which show, for the purposes of illustration only, one embodiment in accordance with the present invention, and wherein:

FIG. 1 is a longitudinal cross-sectional view of a fuel injection nozzle with a throttle pin and rotating means constructed in accordance with the present invention; and FIG. 2 is a cross-sectional view taken along the line II—II in FIG. 1.

Referring now to the drawings wherein like reference numerals are used in both views to designate like parts and, more particularly, to FIG. 1, according to this figure, a rotating means generally designated by the reference numeral 4 is arranged in a throttle-pin fuel injection nozzle between a nozzle needle 1 and a spring disk 3 under a bias of a compression spring 2. The rotating means 4 is adapted to continuously rotate the nozzle needle 1 in a stepwise manner in one peripheral direction during operation.

The rotating means 4 includes a sleeve 5 disposed on the nozzle needle 1, with the sleeve 5 resting on the spring disk 3. The sleeve 5 is arranged so as to be rotatable with respect to the spring disk 3. The rotating means 4 also includes a pivot pin 6, a clamping cone 7, and a stop ring 8 arranged above the clamping cone. The stop ring 8 is biased by a compression spring 9.

As shown most clearly in FIG. 2, the pivot pin 6 lies or is supported in helically extending guides 10 formed in the sleeve 5. The helically extending guides 10 are disposed in mutual opposition with opposite pitch. The pivot pin 6 projects from both sides out of the sleeve 5, with respective ends of the pin resting against the clamping cone 7 in a closed position of the nozzle needle 1.

In a first injection phase, the nozzle needle 1 is lifted by the fuel pressure and, during this process, the pivot pin lying in an upper portion of the guides 10 and resting against the clamping cone 7 is urged out of the clamping cone 7 and is likewise lifted. After a short displacement, the pivot pin 6 is brought into abutment with the stop ring 8; however, since the nozzle needle 1 continues its movement, the pivot pin 6 must, at this stage, rotate about the longitudinal axis of the nozzle needle 1. During a closing of the nozzle needle 1, the pivot pin 6 moves downwardly with the nozzle needle 1 until it again rests in the clamping cone 7. Due to the friction force effective between the surfaces of the guides 10 on the pivot pin 6, the pivot pin 6 is jammed into the clamping cone 7.

The pitch of the guides 10 is selected so that a torque required for turning the nozzle needle 1 is smaller than a torque necessary for rotating the pivot pin 6 about the longitudinal axis of the nozzle needle 1. Therefore, after the pivot pin 6 has been wedged in place, the nozzle needle 1 rotates along the remainder of a return movement about an angle predetermined by the guides 10. During a subsequent injection, the entire procedure is repeated so that the nozzle needle 1 is further rotated by the above-noted angular step during each injection by the fuel injection nozzle.

The compression spring 9 biasing the stop ring 8 serves the purpose of providing for a lifting of the stop ring 8 if, due to manufacturing tolerances or other reasons, the pivot pin 6 is lifted to an excessive extent.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A fuel injection nozzle arrangement for an air-compressing internal combustion engine, the arrangement comprising a nozzle needle means having an opening and closing stroke for controlling an injection of fuel, a valve seat means cooperable with the nozzle needle means, and a compression spring means for normally urging the nozzle needle means into engagement with the valve seat means, the nozzle needle means being adapted to be lifted off the valve seat means by a fuel pressure so as to enable a fuel injection, means are provided for rotating the nozzle needle means about a longitudinal axis thereof in a stepwise manner in one direction of rotation by a predetermined rotational angle during each closing stroke of the nozzle needle means, the rotating means are arranged between the compression spring means and the nozzle needle means, characterized in that the rotating means includes a sleeve means seated on the nozzle needle means, a spring disk means for forming an abutment for one end of the compression spring means is rotatably mounted on the sleeve means, the sleeve means includes mutually opposed guide means for respectively defining oppositely oriented guide paths, a pivot means extends through the sleeve means so as to project from respective sides thereof and is displaceable along said guide means, and in that a clamping cone means cooperates with the respective ends of the pivot pin means in such a manner that the ends of the pivot pin means rests on the clamping cone means when the nozzle means is in a closed position.

2. A fuel injection nozzle arrangement according to claim 1, characterized in that the guide means define oppositely oriented helical guide paths.

3. A fuel injection nozzle arrangement according to claim 2, characterized in that a stop ring means is arranged above the pivot pin means for limiting a displacement of the pivot pin means and for forming an abutment for the compression spring means, the stop ring means is arranged in such a manner that the ends of the pivot pin means abut the stop ring means after a predetermined opening stroke of the nozzle needle means.

4. A fuel injection nozzle arrangement according to claim 3, characterized in that the stop ring means is displaceable against a force of the compression spring means.

5. A fuel injection nozzle arrangement according to claim 4, characterized in that a stop ring means is arranged above the pivot pin means for forming an abutment for the compression spring means, the stop ring means is arranged in such a manner that the ends of the pivot pin means abut the stop ring means after a predetermined opening stroke of the nozzle needle means.

6. A fuel injection nozzle arrangement according to claim 5, characterized in that the stop ring means is displaceable against a force of the compression spring means.

7. A fuel injection nozzle arrangement for an air-compressing internal combustion engine, the arrangement comprising a nozzle needle means having an opening and closing stroke for controlling an injection of fuel, a valve seat means cooperable with the nozzle needle means, and a compression spring means for normally urging the nozzle needle means into engagement with the valve seat means, the nozzle needle means being adapted to be lifted off the valve seat means by a fuel pressure so as to enable a fuel injection, means are provided for rotating the nozzle needle means about a longitudinal axis thereof in a stepwise manner in one direction of rotation by a predetermined rotational angle during each closing stroke of the nozzle needle means, the nozzle needle means is constructed as a throttle-pin, and the valve seat means is constructed as a conical valve seat, the rotating means are arranged between the compression spring means and the nozzle needle means, characterized in that the rotating means includes a sleeve means seated on the nozzle needle means, a spring disk means for forming an abutment for one end of the compression spring means is rotatably mounted on the sleeve means, the sleeve means includes mutually opposed guide means for respectively defining oppositely oriented guide paths, a pivot means extends through the sleeve means so as to project from respective sides thereof and is displaceable along said guide means, and in that a clamping cone means cooperates with the respective ends of the pivot pin means in such a manner that the ends of the pivot pin means rests on the clamping cone means when the nozzle needle means is in a closed position.

* * * * *